United States Patent [19]

Arippol

[11] 4,348,816

[45] Sep. 14, 1982

[54] METHOD AND APPARATUS FOR RAPID DRYING OF CONTAINER COVERS

[76] Inventor: Raimondo Arippol, Avenida dos Autonomistas 1117, Osasco, Sao Paulo, Brazil

[21] Appl. No.: 229,657

[22] Filed: Jan. 29, 1981

[51] Int. Cl.[3] ..... F26B 3/04

[52] U.S. Cl. ..... 34/13; 34/33; 34/66; 34/233; 198/416; 198/633

[58] Field of Search ..... 198/415, 416, 394, 633; 34/104, 105, 225, 233, 107, 216, 66

[56] References Cited

U.S. PATENT DOCUMENTS

| | | | |
|---|---|---|---|
| 2,707,547 | 5/1955 | Gewecke | 198/394 |
| 3,755,916 | 9/1973 | Gulaian | 34/105 |
| 3,848,394 | 11/1974 | Heisler | 198/394 |

*Primary Examiner*—Larry I. Schwartz
*Attorney, Agent, or Firm*—Holman & Stern

[57] ABSTRACT

An apparatus and a method for drying substantially flat and approximately circular workpieces, such as container covers, by transporting the covers by means of a conveyor belt through a heated zone and subsequently a cooling zone. The covers are maintained at an acute angle with respect to a lateral edge of the conveyor belt by means of a guide disposed adjacent and parallel to the conveyor belt, which serves to elevate one side of the covers. Simultaneous contact of the covers with the conveyor belt and guide causes linear and rotational motion of the covers in the direction of movement of the conveyor belt. The space between the covers and the conveyor belt permits circulation of air beneath the covers to allow removal of liquids.

16 Claims, 6 Drawing Figures

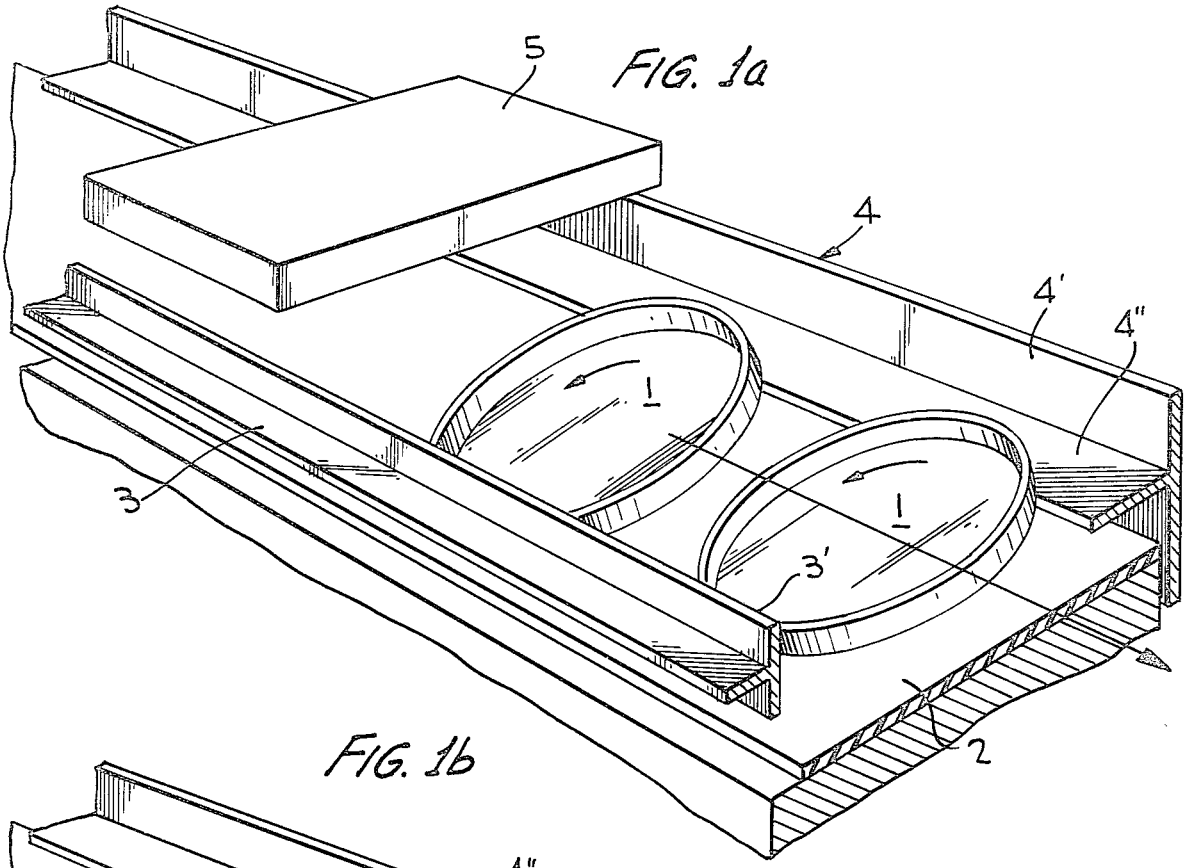
FIG. 1a
FIG. 1b
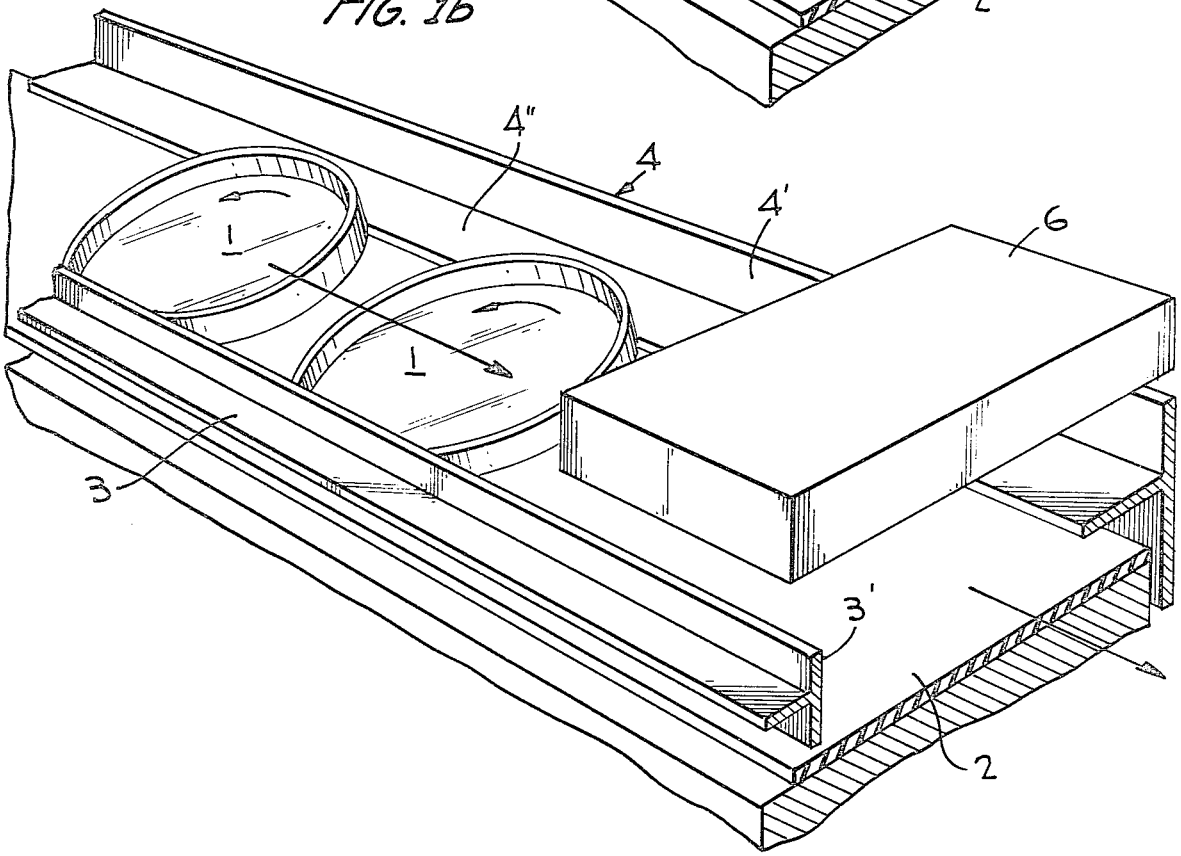

METHOD AND APPARATUS FOR RAPID DRYING OF CONTAINER COVERS

BACKGROUND OF THE INVENTION

1. Field of the Invention

This invention is directed to a method for drying generally flat circular objects such as container covers, particularly those made of a thermoplastic material. The method employed permits such objects to be dried both quickly and efficiently. By use of the method of the present invention, the dried covers may be transported or further treated, if such is necessary, immediately after the cover is removed from the treatment apparatus. As a result, a greater number of covers may be dried per unit of time.

2. Description of the Prior Art

The methods of drying container covers known heretofore have not been concerned particularly with rapid means for drying such objects. Conventional manufacturing procedures normally are passive and permit such objects to be dried by air or atmospheric contact. Thus, subsequent to their production by thermal molding means, they are simply set aside and any resultant moisture is dissipated by evaporation. Such a process is inherently slow. This is particularly true when theremoplastic materials, such as polyalkylenes, particularly polyethylene or polypropylene, are the materials selected for the production of such covers. The manufacturing techniques which are frequently employed with such materials include thermal means and as a result require slow gentle movements to avoid agglomeration while the objects are still hot.

SUMMARY OF THE INVENTION

The method of the present invention permits container covers to be rapidly dried and thereafter to be stacked, transported or undergo further treatment. The process can be carried out without regard to the composition of the covers, and thus, when the covers are formed from a thermoplastic material, such as a polyalkylene, the drying process proceeds rapidly and efficiently without deformation or agglomeration of the objects. The instant method is carried out by placing the container covers or lids, which are approximately circular in configuration, on a conveyor belt. The covers are partially elevated by resting an edge of the cover on a guide which extends the length of the conveyor belt and parallel and adjacent to one of the lateral edges of the conveyor belt. The edges of the covers rest on a portion of the guide which projects inwardly and overhangs the conveyor belt. At the other lateral edge of the belt is placed another guide which also extends the length of the conveyor belt and is parallel and adjacent to the other lateral edge of the belt. This guide prevents the covers from sliding off the conveyor belt and may overhang the belt to a slight extent.

In operation, the movement of the conveyor belt in contact with an edge of the cover causes it to rotate and move in the direction of motion of the conveyor belt. Since the lids or covers are partially elevated in an inclined position, air currents easily circulate between the cover and the conveyor belt to permit removal of residual moisture or solvents from the underside of the covers. As the covers are rotatably moved by the conveyor belt, they first pass through a heated zone and subsequently, if necessary, a cooling zone. The heat supplied to the heated zone may be from any suitable source appropriately disposed to provide a heat gradient or environment at a particular region of the conveyor belt. Any suitable cooling means which provides a source of cool air to the warm covers is suitably disposed downstream of the heat source. This arrangement permits the rotating covers to encounter a heated zone which causes adhering liquids to be vaporized and then subsequently enter a cooling zone whereby the now dry covers may be sufficiently cooled to permit subsequent manipulations without causing deformations to occur when thermoplastic materials are employed.

BRIEF DESCRIPTION OF THE DRAWINGS

The details of the present invention and the manner in which it is operated may be more easily understood by reference to the drawings and the following description. The drawings are meant to be illustrative of the present invention but are not intended to limit or in any other way modify the instant invention.

FIG. 1*a* is a perspective partial view of the assembly with a heating unit as it appears in operation.

FIG. 1*b* is a perspective partial view of the assembly with a cooling unit as it appears in operation.

DESCRIPTION OF THE PREFERRED EMBODIMENTS

The following description is provided in order that the method of the instant invention and the means and apparatus for effecting the method may be fully understood.

Figure 2:
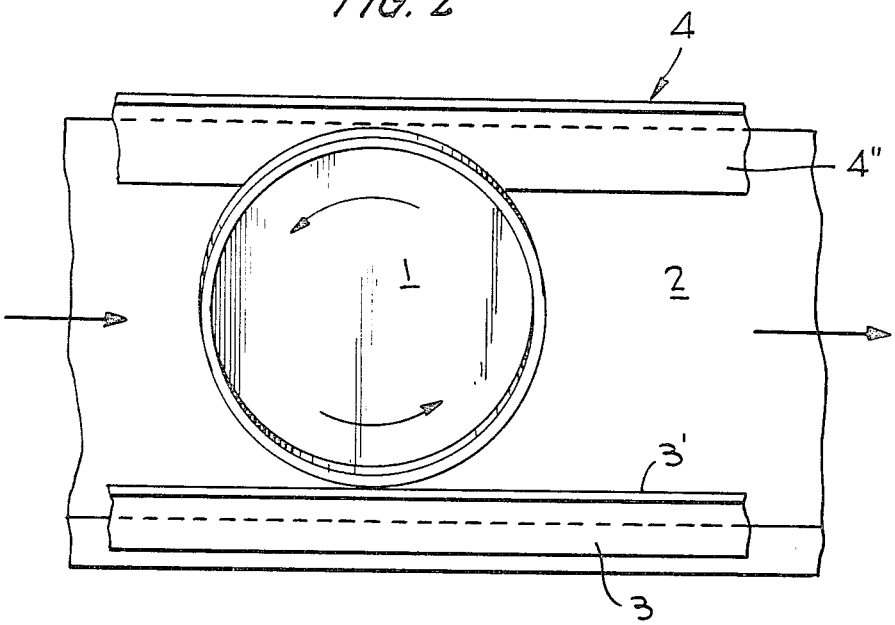
FIG. 2 is a top view of the assembly in operation.
Figure 3:
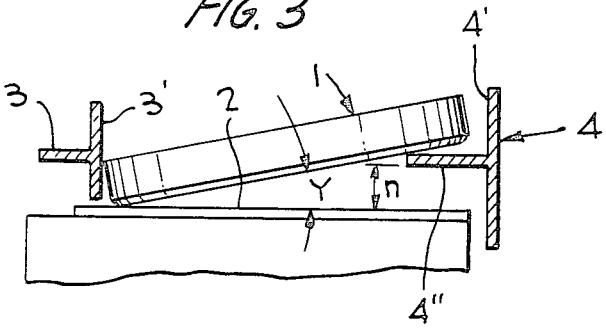
FIG. 3 is a side view of the assembly in operation.
Figure 4:
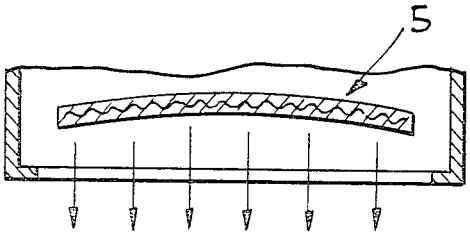
FIG. 4 is a side view of the heating means.
Figure 5:
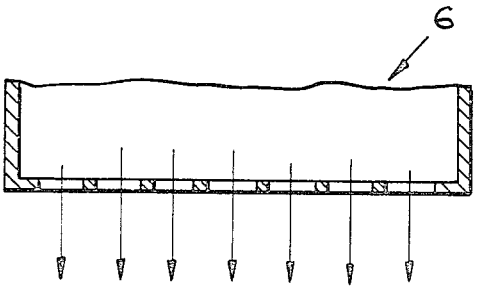
FIG. 5 is a side view of the cold air source.

The covers (1) are placed in an inclined position such that a lower edge rests on the conveyor belt. The actual belt or mat (2) on which the covers (1) rest may be made of cloth, rubber, or any other suitable material or composite of the aforementioned materials. Guides or end plates (3 and 4) are placed at the opposite lateral edges of the conveyor belt. Elevational guide (4) is disposed at one edge of the conveyor belt to maintain the covers in an inclined position. While any suitable configuration which maintains the covers in such a position is satisfactory, a preferred form is one which provides a substantially horizontal portion projecting over the mat (2). The most preferred configuration is one which not only supports the cover (1) at an acute angle with respect to the opposite lateral edge of the mat but also prevents it from rolling off the conveyor belt while the apparatus is operational. The particular configuration shown in FIG. 3, taking the shape of a "T" positioned on its side, is ideally suited to these objectives. As illustrated in FIG. 4, the horizontal portion (4'') of guide (4) elevates the edge of cover (1) while the upper vertical portion (4') of guide (4) prevents the cover from rotating off the belt while the apparatus is operational. At the opposite lateral edge of the conveyor belt, a second guide (3) is provided to deflect the rotating covers and prevent them from slipping off that side of the conveyor while the system is operational. The second guide (3) may have any suitable configuration; however, the side which potentionally or actually comes in contact with the covers should be substantially vertical and of such height as to prevent the rotating covers from riding over the guide and off the belt. As illustrated in FIG. 3, the second guide (3), like the elevated guide (4), is formed in the shape of a "T" positioned on its side. It may also be observed that the second guide (3) is positioned above and within the lateral edge of the mat (2).

The particular arrangement of the mat (2), guides (3 and 4) and cover (1), ad described above and illustrated in the drawings, permits the covers to be transported on the conveyor belt while being rotated in an inclined position without significant side-to-side movements. This further permits the heating and cooling, as described below, to be most effectice, since air circulates around all sides of the covers.

As previously indicated, any suitable heat source may be employed and disposed in any suitable position which allows adequate heat and circulation of heated air around the moving covers. However, the heat source is placed preferably above the conveyor belt. Although any suitable means of providing heat to the moving covers may be employed, the heat source (5) illustrated in FIG. 4, is most preferably an electrical resistor or a series of resistors. The heat source (5) is preferably positioned directly over the conveyor belt at a suitable height, which is determined in conjunction with the means for regulating the heat output such that sufficient heat is produced but not high enough to cause deformation of covers which are formed from a thermoplastic material. The heat source may be positioned within a partially enclosed housing centered over the conveyor belt as illustrated in FIG. 1.

In order to provide a rapid method of drying covers without deformation (in such cases where a thermoplastic material is used for the covers), the covers, after passing through the heated zone, are conveyed through a cooling zone. Any suitable cooling means may be employed. Preferably, however, the cooling unit, like the heat source, will be positioned over the conveyor belt in order to maximize the cooling effect. The cooling means (6) will normally include a cooling or refrigeration unit and a fan to circulate the cool air as well as duct or louvre means to direct the cool air toward the moving covers. Like the heating unit, it may be partially enclosed in a housing which lies over the conveyor belt.

What I claim is:

1. A method of drying a substantially flattened and approximately circular workpiece comprising:
- transporting said workpiece on an apparatus comprising
- a structural support having
  - conveyor belt means movably mounted therein and adapted to transport said workpiece, said conveyor belt means having a first lateral edge and a second lateral edge,
  - an upstanding laterally fixed elevated guide means comprising an inwardly-projecting substantially horizontal member and an upwardly-projecting member extending therefrom, said elevated guide means extending above and parallel to the second lateral edge, and
  - an upstanding laterally fixed deflector guide means extending parallel to the first lateral edge, such that the workpiece is transported by the conveyor belt means in a plane defined by the first lateral edge and the elevated guide means at an acute angle, the workpiece having both a rotational motion and a linear motion imparted to it by the movement of the conveyor belt means; and
  - heating the workpiece with a heating means disposed along said conveyor belt means capable of evaporating liquids associated with said workpiece.

2. The method of claim 1, wherein a cooling means capable of cooling said workpiece is disposed along said conveyor belt means downstream from said heating means.

3. The method of claim 2, wherein said cooling means comprises a refrigeration unit, a fan to remove cooled air from the vicinity of the regrigeration unit and at least one duct to direct the cooled air toward said conveyor belt means.

4. The method of claim 1, wherein said heating means comprises at least one electrical resistor.

5. The method of claim 1, wherein said heating means is located within a housing centered over and partially enclosing said conveyor belt means.

6. The method of claim 2, wherein said cooling means is located within a housing centered over and partially enclosing said conveyor belt means.

7. The method of claim 1, wherein said elevated guide means has a cross-sectional configuration of a T positioned on its side.

8. The method of claim 1, wherein said deflector guide means is positioned at approximately the same height as said elevated guide means.

9. An apparatus for drying substantially flattened and approximately circular workpieces comprising:
- a structural support having
  - conveyor belt means movably mounted therein and adapted to transport said workpieces, said conveyor belt means having a first lateral edge and a second lateral edge,
  - an upstanding laterally fixed elevated guide means comprising an inwardly-projecting substantially horizontal member and an upwardly-projecting member extending therefrom, said elevated guide means, extending above and parallel to the second lateral edge, and
  - an upstanding laterally fixed deflector guide means extending parallel to the first lateral edge, whereby the workpiece when placed in a plane defined by the first lateral edge and the elevated guide means has both a rotational motion and a linear motion imparted to it by the movement of the conveyor belt means; and
  - heating means disposed along said conveyor belt means capable of evaporating liquids associated with said workpiece.

10. The apparatus of claim 9, wherein a cooling means capable of cooling said workpieces is disposed along said conveyor belt means downstream from said heating means.

11. The apparatus of claim 10, wherein said cooling means comprises a refrigeration unit, a fan to remove cooled air from the vicinity of the refrigeration unit and at least one duct to direct the cooled air toward said conveyor belt means.

12. The apparatus of claim 9, wherein said heating means comprises at least one electrical resistor.

13. The apparatus of claim 9, wherein said heating means is located within a housing centered over and partially enclosing said conveyor belt means.

14. The apparatus of claim 10, wherein said cooling means is located within a housing centered over and partially enclosing said conveyor belt means.

15. The apparatus of claim 9, wherein said elevated guide means has a cross-sectional configuration of a T positioned on its side.

16. The apparatus of claim 9, wherein said deflector guide means is positioned at approximately the same height as said elevated guide means.

* * * * *